US008744323B2

(12) United States Patent
Sato et al.

(10) Patent No.: US 8,744,323 B2
(45) Date of Patent: Jun. 3, 2014

(54) DEVELOPING CARTRIDGE INCLUDING DOCTOR BLADE REGULATING DEVELOPER ON DEVELOPER CARRYING MEMBER

(75) Inventors: Shougo Sato, Seto (JP); Fan Xu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 102 days.

(21) Appl. No.: 13/406,162

(22) Filed: Feb. 27, 2012

(65) Prior Publication Data

US 2012/0251190 A1 Oct. 4, 2012

(30) Foreign Application Priority Data

Mar. 31, 2011 (JP) ..... 2011-077394

(51) Int. Cl.
*G03G 15/08* (2006.01)

(52) U.S. Cl.
USPC ..... 399/284

(58) Field of Classification Search
USPC ..... 399/284, 274
See application file for complete search history.

(56) References Cited

U.S. PATENT DOCUMENTS

| | | | | |
|---|---|---|---|---|
| 5,220,129 | A * | 6/1993 | Nishio et al. | 399/284 |
| 8,190,072 | B2 * | 5/2012 | Wada et al. | 399/274 |
| 8,489,003 | B2 * | 7/2013 | Ebe | 399/284 |
| 2001/0026715 | A1 | 10/2001 | Tatsumi | |
| 2005/0095525 | A1 * | 5/2005 | Kunugi et al. | 399/284 |
| 2005/0175378 | A1 * | 8/2005 | Aoki | 399/284 |
| 2006/0239724 | A1 | 10/2006 | Fuwazaki et al. | |
| 2009/0220286 | A1 | 9/2009 | Kurihara | |

FOREIGN PATENT DOCUMENTS

| | | | |
|---|---|---|---|
| JP | 2001-281985 | A | 10/2001 |
| JP | 2006-301481 | A | 11/2006 |
| JP | 2007-156012 | A | 6/2007 |
| JP | 2009-204917 | A | 9/2009 |
| JP | 2010-102327 | A | 5/2010 |

* cited by examiner

*Primary Examiner* — Sophia S Chen
(74) *Attorney, Agent, or Firm* — Baker Botts L.L.P.

(57) ABSTRACT

Developing cartridge includes doctor blade in contact with developer carrying member. The doctor blade includes supporting plate having proximal end portion and distal end portion. Pressing portion is provided on the distal end portion to define contacting portion at which the doctor blade contacts surface of the developer carrying member. The pressing portion has end face extending in a direction away from the developer carrying member from the contacting portion and facing an upstream side in rotational direction of the developer carrying member. The proximal end portion is positioned downstream from the contacting portion in the rotational direction of the developer carrying member. Angle α between the end face and a plane tangent to the contacting portion, at a position in proximity to the developer carrying member, is not smaller than 90 degrees, as viewed in cross section orthogonal to axis of rotation of the developer carrying member.

5 Claims, 6 Drawing Sheets

RELEVANT ART

DEVELOPING CARTRIDGE INCLUDING DOCTOR BLADE REGULATING DEVELOPER ON DEVELOPER CARRYING MEMBER

CROSS-REFERENCE TO RELATED APPLICATION(S)

This application claims priority from Japanese Patent Application No. 2011-077394 filed on Mar. 31, 2011, the disclosure of which is incorporated herein by reference in its entirety.

TECHNICAL FIELD

The present invention relates to a developing cartridge comprising a developer carrying member such as a developing roller, and a doctor blade configured to regulate the thickness of developer carried on the developer carrying member.

BACKGROUND ART

In general, a developing cartridge includes a photoconductor drum on which an electrostatic latent image is to be formed, a developer carrying member rotatable with and contacting the photoconductor drum to supply developer on the photoconductor drum, and a doctor blade configured to contact the developer carrying member and to regulate the thickness of the developer layer carried on the developer carrying member while the developer carrying member is rotating. In one known developing cartridge, a doctor blade is bent at an acute angle at its portion contacting the developer cattier; to be more specific, a distal end portion of the doctor blade is bent at an acute angle and extends in a direction away from the developer carrying member. The developer carried on the developer carrying member is charged when passing under the doctor blade, and the charged developer is then supplied to an exposed area of the photoconductor drum.

According to this conventional developing cartridge, if the thickness of the developer layer carried on the developer carrying member is thick, the developer layer is compressed at an interface between the developer carrying member and the photoconductor drum, and the compressed developer may disadvantageously flow into or be scattered over a non-exposed area of the surface of the photoconductor drum, with the result that printing failure such as fog occurs.

Further, the doctor blade is configured such that the bent portion thereof slidably contacts the developer carrying member at a contacting edge of the bent portion, and an angle between the plane tangent to the developer carrying member and passing through the contacting edge and the bent portion at the distal end of the doctor blade becomes an acute angle. Accordingly, foreign objects such as developer and paper powder would easily enter an interface between the developer carrying member and the doctor blade. If foreign objects enter the interface and they are compressed with the developer, the mixture (aggregate) of developer and the foreign objects adheres to the surface of the photoconductor drum, which leads to printing failure.

In view of the above, it would be desirable to provide a developing cartridge which can reduce the thickness of the developer layer carried on the developer carrying member and prevent foreign objects from adhering to the developer carrying member.

SUMMARY OF THE INVENTION

According to the present invention, a developing cartridge comprises: a casing configured to store developer; a developer carrying member rotatably supported by the casing and configured to carry developer on a surface thereof; and a doctor blade provided in contact with the developer carrying member to regulate a thickness of developer carried on the developer carrying member. The developer carrying member is rotatable with a photoconductor on which an electrostatic latent image is formed while contacting the photoconductor, to thereby supply developer onto the photoconductor. In this developing cartridge, the doctor blade includes a supporting plate having a proximal end portion supported by the casing and a distal end portion contacting the developer carrying member, and a pressing portion is provided on the distal end portion to define a contacting portion at which the doctor blade contacts the surface of the developer carrying member. The pressing portion has an end face extending in a direction away from the developer carrying member from the contacting portion and facing an upstream side in a rotational direction of the developer carrying member. The supporting plate of the doctor blade is supported by the casing such that the proximal end portion thereof is positioned downstream from the contacting portion of the pressing portion in the rotational direction of the developer carrying member, and an angle $\alpha$ between the end face and a plane tangent to the contacting portion, at a position in proximity to the surface of the developer carrying member, is equal to or greater than 90 degrees, as viewed in a cross section orthogonal to an axis of rotation of the developer carrying member.

BRIEF DESCRIPTION OF THE DRAWINGS

To better understand the claimed invention, and to show how the same may be carried into effect, reference will now be made, by way of example only, to the accompanying drawings, in which:

FIGS. 4A and 4B are sectional views of a developing cartridge according to a modified embodiment, in which FIG. 4A shows a state in which toner is not agitated, and FIG. 4B shows a state in which toner is being agitated;

FIGS. 6A to 6D are views each showing relationship between the developing roller and the doctor blade according to a conventional developing cartridge, in which FIGS. 6A to 6C show the pressing portion of the doctor blade and the vicinity thereof, and FIG. 6D is an enlarged view showing the contacting portion.

DESCRIPTION OF EMBODIMENT

Figure 1:
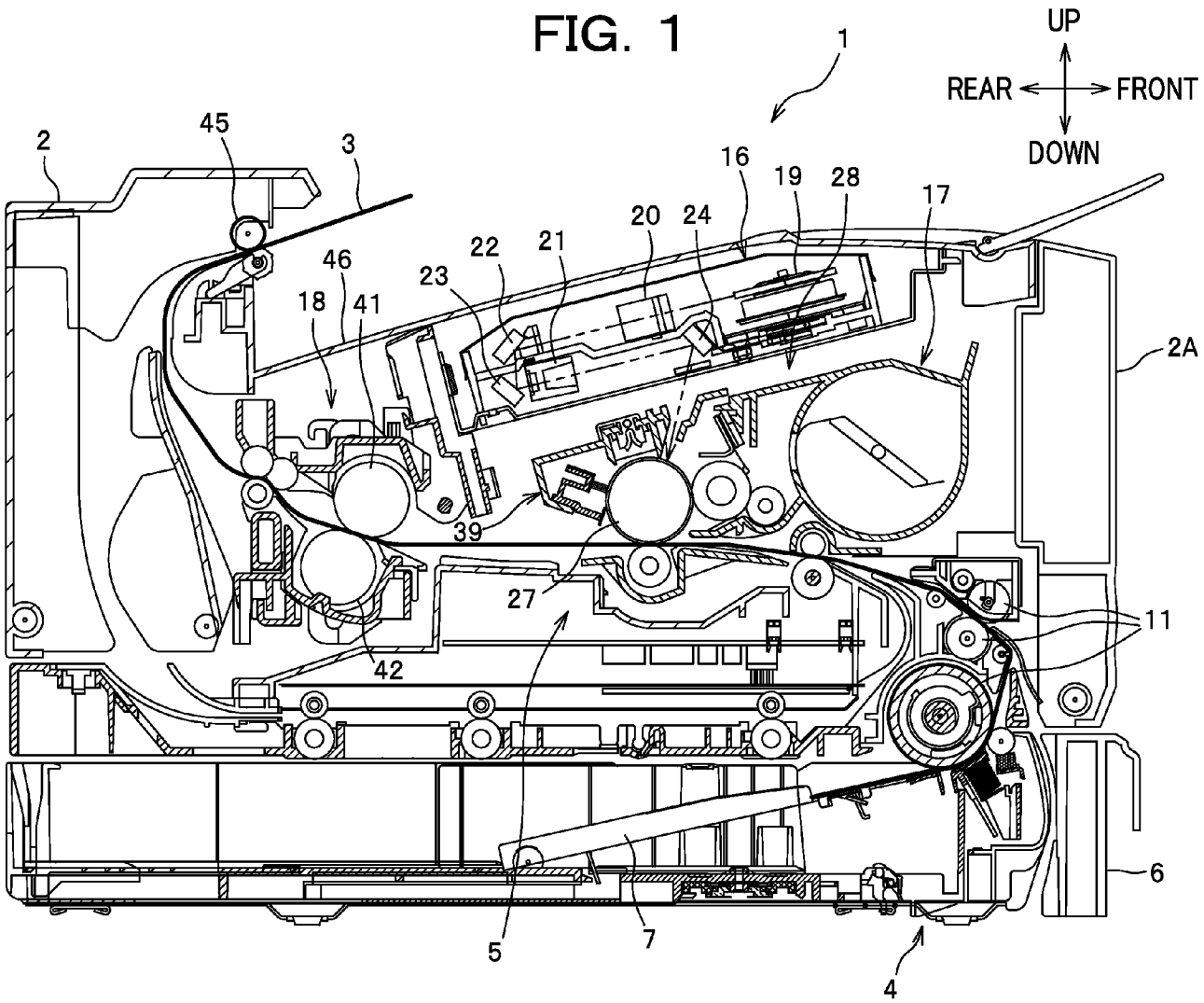
FIG. 1 is a side sectional view of a laser printer in which a developing cartridge according to one exemplary embodiment of the present invention is incorporated.

Detailed description will be given of an illustrative embodiment of the present invention with reference to the accompanying drawings. In the following description, a general arrangement of a laser printer (image forming apparatus), to which a developing cartridge according to the present embodiment is attached and used, will be described, and thereafter characteristic features of the present embodiment will be described in detail.

In the following description, the direction is designated as from the viewpoint of a user who is using (operating) the laser printer. To be more specific, in FIG. 1, the right-hand side of the drawing sheet corresponds to the "front" side of the laser printer, the left-hand side of the drawing sheet corresponds to the "rear" side of the laser printer, the front side of the drawing sheet corresponds to the "left" side of the laser printer, and the back side of the drawing sheet corresponds to the "right" side of the laser printer. Similarly, the direction extending from top to bottom of the drawing sheet corresponds to the "vertical" or "upward-and-downward (up/down, upper/lower or top/bottom)" direction of the laser printer.

General Arrangement of Laser Printer

As seen in FIG. 1, the laser printer 1 comprises a main body casing 2, and several components housed in the main body casing 2 which principally includes a sheet feeder unit 4 for feeding a sheet 3 (e.g., of paper), and an image forming unit 5 for forming an image on the sheet 3.

The sheet feeder unit 4 includes a sheet feed tray 6 detachably installed in a lower space within the main body casing 2, a sheet pressure plate 7 provided in the sheet feed tray 6, and various rollers 11 such as for conveying the sheet 3. Sheets 3 stored in the sheet feed tray 6 are urged upward by the sheet pressure plate 7, separated one from the other, and conveyed by the rollers 11 into the image forming unit 5.

The image forming unit 5 includes a scanner unit 16, a process cartridge 17, and a fixing unit 18.

The scanner unit 16 is provided in an upper space within the main body casing 2. The scanner unit 16 is configured to cause a laser beam produced based upon image data to travel along a path indicated by chain double-dashed lines, by reflecting or transmitting the same at a polygon mirror 19, a lens 20, reflecting mirrors 22, 23, a lens 21, and a reflecting mirror 24 in this order, so that a peripheral surface of a photoconductor drum 27 is rapidly scanned and illuminated with the laser beam.

The process cartridge 17 is configured to be detachably attached to the main body casing 2 through an opening formed when a front cover 2A provided at a front side of the main body casing 2 is swung open. The process cartridge 17 principally includes a developing cartridge 28 and a drum unit 39.

Figure 2:
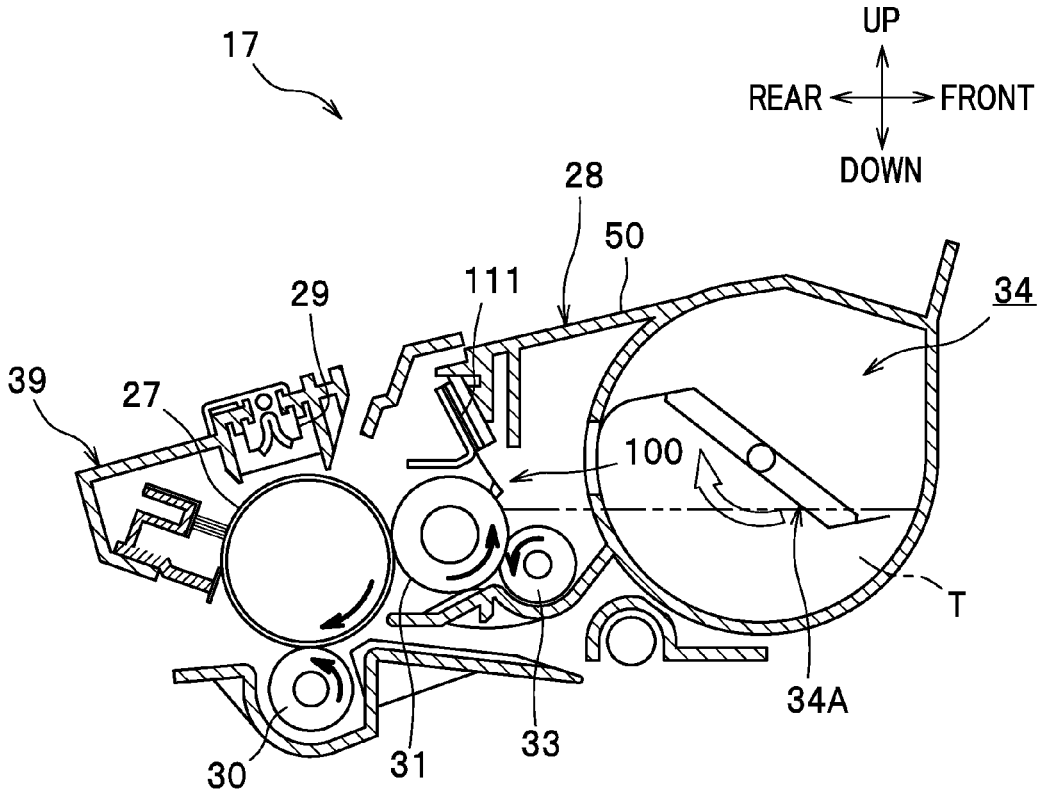
FIG. 2 is a sectional view of the developing cartridge.

The developing cartridge 28 is designed to be assembled together with the drum unit 39, and the assembly of the developing cartridge 28 and the drum unit 39 is then detachably attached to the main body casing 2. It is to be noted that the developing cartridge 28 may be designed to be detachably attached to the drum unit 39 that is fixed to the main body casing 2. As best seen in FIG. 2, the developing cartridge 28 includes a case body 50 as an example of a casing, a developing roller 31 as an example of a developer carrying member, a doctor blade 100, and a supply roller 33. A toner storage chamber 34 is formed in the case body 50; the toner storage chamber 34 is configured to store toner T as an example of developer.

According to this developing cartridge 28, toner T is agitated by an agitator 34A in the toner storage chamber 34, and the toner T is supplied from the supply roller 33 to the developing roller 31, during which the toner T is charged positively by friction between the supply roller 33 and the developing roller 31. As the developing roller 31 rotates, the toner T supplied onto the developing roller 31 passes through between the doctor blade 100 and the developing roller 31, and is frictionally charged therebetween and carried on the developing roller 31 as a thin layer of toner T having a constant thickness. The structure of the developing cartridge 28 will be described later in greater detail.

The drum unit 39 principally includes a photoconductor drum 27, a scorotron charger 29, and a transfer roller 30. In the drum unit 39, the peripheral surface of the photoconductor drum 27 is uniformly and positively charged by the scorotron charger 29, and then exposed to a rapidly sweeping laser beam from the scanner unit 16. Accordingly, the electric potential of the exposed area lowers, so that an electrostatic latent image based on the image data is formed on the photoconductor drum 27.

Further, as the developing roller 31 rotates with the photoconductor drum 27 while contacting the photoconductor drum 27, the positively charged toner T that is carried on the peripheral surface of the developing roller 31 is supplied to the electrostatic latent image formed on the peripheral surface of the photoconductor drum 27. Accordingly, the electrostatic latent image is visualized and a toner image is formed on the surface of the photoconductor drum 27. Thereafter, while the sheet 3 is conveyed through between the photoconductor drum 27 and the transfer roller 30, the toner image carried on the surface of the photoconductor drum 27 is transferred onto the sheet 3.

As seen in FIG. 1, the fixing unit 18 includes a heating roller 41 and a pressure roller 42 pressed against the heating roller 41. In the fixing unit 18, the toner image (i.e., toner T) transferred onto the sheet 3 is thermally fixed on the sheet 3 while the sheet 3 passes through between the heating roller 41 and the pressure roller 42. The sheet 3 with the toner image thermally fixed thereon by the fixing unit 18 is conveyed to the sheet eject roller 45 disposed at a downstream side of the fixing unit 18, and ejected by the sheet eject roller 45 onto a sheet output tray 46.

Detailed Structure of Developing Cartridge

Detailed description will be given of the doctor blade 100 and the perimeter structure of the doctor blade 100 within the developing cartridge 28, which constitute characteristic features of the present invention.

Figure 3A:
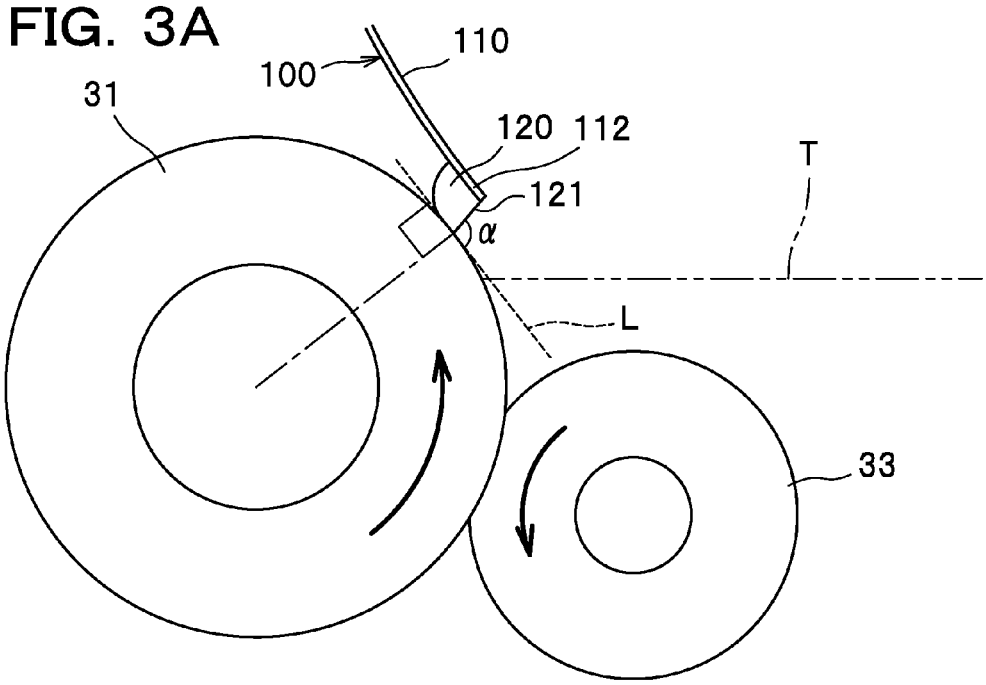
FIG. 3A is a schematic view showing a developing roller, a doctor blade, and a supply roller.

As best seen in FIGS. 2 and 3A, the doctor blade 100 is provided in contact with the developing roller 31 to regulate the thickness of toner T carried on the developing roller 31, while the developing roller 31 is rotating. The doctor blade 100 principally includes a supporting plate 110 having a proximal end portion 111 supported by the case body 50 and a distal end portion 112 contacting the developing roller 31.

Figure 3B:
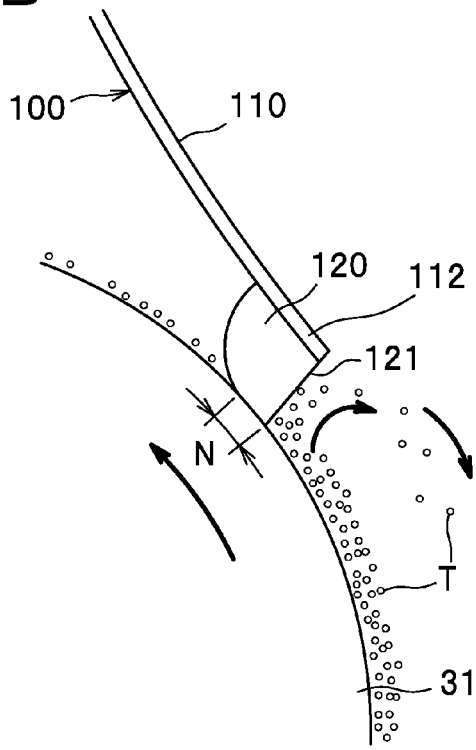
FIG. 3B is an enlarged view showing a contacting portion at which the doctor blade contacts the developing roller.

The supporting plate 110 is made of a thin metal plate. As best seen in FIG. 3B, a pressing portion 120 is supported on the distal end portion 112 of the supporting plate 110 to define a contacting portion N at which the doctor blade 100 contacts the peripheral surface of the developing roller 31. As seen in FIG. 2, the supporting plate 110 is supported by the case body 50 such that the proximal end portion 111 is positioned downstream from the contacting portion N in the rotational direction of the developing roller 31.

The pressing portion 120 is made of rubber. The pressing portion 120 is provided on the distal end portion 112 of the supporting plate 110 in such a manner as to protrude from the supporting plate 110 toward the developing roller 31, so that an edge of the pressing portion 120 contacts the developing roller 31 to define the contacting portion N. Further, the pressing portion 120 has an end face 121 extending diagonally upward and frontward (i.e., in a direction away from the developing roller 31) from the contacting portion N (more specifically, from the upstream end of the contacting portion N as viewed in the rotational direction of the developing roller 31) and facing an upstream side in the rotational direction of the developing roller 31. In this embodiment, the end face 121 is a flat surface.

As best seen in FIG. 3A, the doctor blade 100 configured as described above is fixed to the case body 50 such that, as viewed in the cross section orthogonal to the axis of rotation of the developing roller 31, an angle α between the end face 121 and the line (tangent line) L tangent to the contacting portion N is equal to or greater than 90 degrees.

Figure 6A:
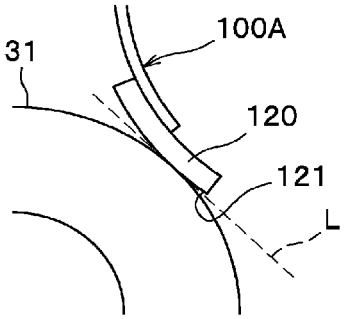
Figure 6B:
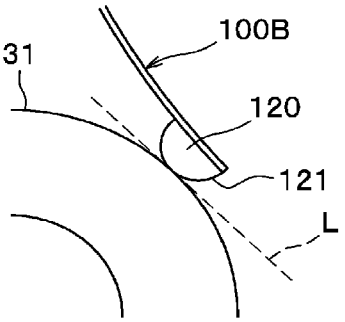
Figure 6C:
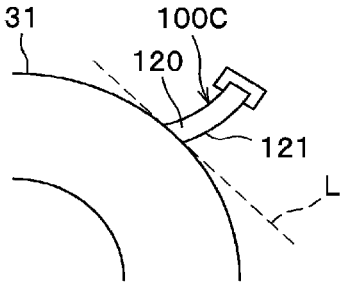
Figure 6D:
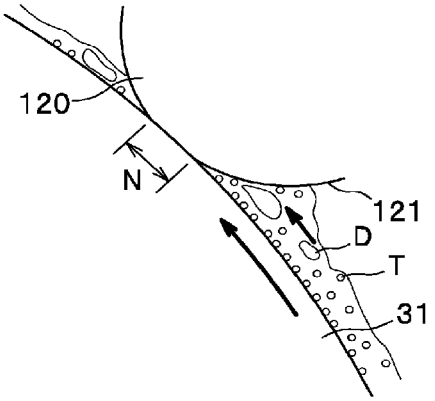

As best seen in FIGS. 6A to 6C, conventionally known doctor blades 100A, 100B, 100C are provided such that an angle between the end face 121 and the line (tangent line) L tangent to the contacting portion N on the surface of the developing roller 31 is an acute angle (i.e., angle smaller than 90 degrees), as viewed in the cross section orthogonal to the axis of rotation of the developing roller 31. According to these configurations, as seen in FIG. 6D, foreign objects such as toner T and paper powder would easily flow toward the contacting portion N, with the result that the toner T and the foreign objects are mixed and compressed together at the contacting portion N and the aggregate thereof may go through the contacting portion N. As a consequence, a thick toner layer is carried on the surface of the developing roller 31 that has passed through the contacting portion N or the toner layer contains foreign objects D, which leads to printing failure.

On the contrary, according to this embodiment, providing the doctor blade 100 as described above can obviate the aforementioned drawback of the conventionally known doctor blades 100A, 100B, 100C, and an excess toner layer carried on the surface of the developing roller 31 can be scraped off by the contacting portion N to effectively remove the foreign objects. It is preferable that the angle α is an obtuse angle (α>90 degrees) so that the excess toner scraped off from the developing roller 31 is not accumulated in the vicinity of the contacting portion N. Setting the angle α to an obtuse angle makes it possible to cause the scraped toner T to smoothly flow away from the contacting portion N.

In order to readily form a uniform and thin toner layer on the surface of the developing roller 31, toner T stored in the toner storage chamber 34 is composed of spherical toner particles. The amount of toner T stored in the toner storage chamber 34 is adjusted such that the level of the toner T is lower than the contacting portion N of the doctor blade 100. It is to be noted that the level of the toner T indicates the height of the toner T at its surface within the toner storage chamber 34 as measured when the agitator 34A is stopped and the surface level of the toner T is evened out. By adjusting the amount of toner T to this level, as seen in FIG. 3B, the excess toner T that has been scraped off by the contacting portion N flows outside along the end face 121 and thereafter drops down. Therefore, the excess toner T scraped off by the doctor blade 100 is less likely to be accumulated in the vicinity of the contacting portion N.

Operation and advantageous effects of the developing cartridge 28 configured as described above will be described.

In the developing cartridge 28, as seen in FIG. 3A, a sufficient amount of toner T is supplied from the supply roller 33 to the surface of the developing roller 31, and a relatively thick toner layer is formed on the surface of the developing roller 31. And, as shown in FIG. 3B, the excess toner T carried on the surface of the developing roller 31 is scraped off by the doctor blade 100. Since the doctor blade 100 is provided such that the angle α is equal to or greater than 90 degrees, the excess toner T carried on the surface of the developing roller 31 can be effectively scraped off by the pressing portion 120, namely, an extra amount of toner is less likely to enter the interface between the developing roller 31 and the contacting portion N. Therefore, a thin toner layer can be formed on the surface of the developing roller 31 that has passed through the contacting portion N. Further, unlike the conventional developing cartridges in which foreign objects such as toner and paper powder would easily flow toward the contacting portion N, the developing cartridge 28 in this embodiment does not allow foreign objects to pass under the contacting portion N. Therefore, the amount of foreign objects such as paper powder mixed with the toner layer carried on the developing roller 31 can be reduced, and it is possible to reduce printing failure derived from foreign objects adhering to the surface of the photoconductor drum 27.

Since the end face 121 is a flat surface and the angle α is an obtuse angle, even if the pressing portion 120 is worn out due to sliding contact with the developing roller 31, the angle α can be effectively maintained as compared with an acute-angled end face.

In the developing cartridge 28 according to the above embodiment, since the angle α is an obtuse angle, the excess toner T that has been scraped off by the contacting portion N effectively flows outside and is less likely to be accumulated in the vicinity of the contacting portion N. This can prevent foreign objects such as paper powder from being accumulated and mixed together with the toner T in the vicinity of the contacting portion N. Therefore, unlike the conventional developing cartridge as shown in FIG. 6D, the amount of foreign objects adhering to the surface of the developing roller 31 can be reduced. As a result, it is possible to reduce printing failure due to foreign objects or aggregate of the foreign objects adhering to the surface of the photoconductor drum 27.

Further, since the pressing portion 120 is made of rubber, the surface of the developing roller 31 will not be damaged by the sliding contact with the developing roller 31. The pressing portion 120 contacts the developing roller 31 and is slightly worn out, which can prevent a large amount of toner T from adhering to the pressing portion 120. With this configuration, a more than necessary amount of toner will not be scraped off from the surface of the developing roller 31 by the toner T adhering to the pressing portion 120.

Since spherical toner is used instead of grinded toner, reducing the thickness of the toner layer will not likely to cause unevenness of the toner layer, and a thin layer of toner having a constant thickness can be easily formed on the developing roller 31. Further, the doctor blade 100 in the above embodiment can prevent foreign objects with irregular shape from passing under the contacting portion N, while efficiently allowing passage of the spherical toner.

Further, since the level of the toner T stored in the developing cartridge 28 is lower than the contacting portion N, the excess toner or the foreign objects scraped off by the doctor blade 100 will not be accumulated in the vicinity of the contacting portion N and drop down without fail. This can prevent foreign objects from being mixed with the toner layer carried on the developing roller 31 that has passed through the contacting portion N.

Although an illustrative embodiment of the present invention has been described in detail, the present invention is not limited to this specific embodiment. It is to be understood that various changes and modifications may be made where necessary without departing from the scope of the appended claims.

Figure 4A:
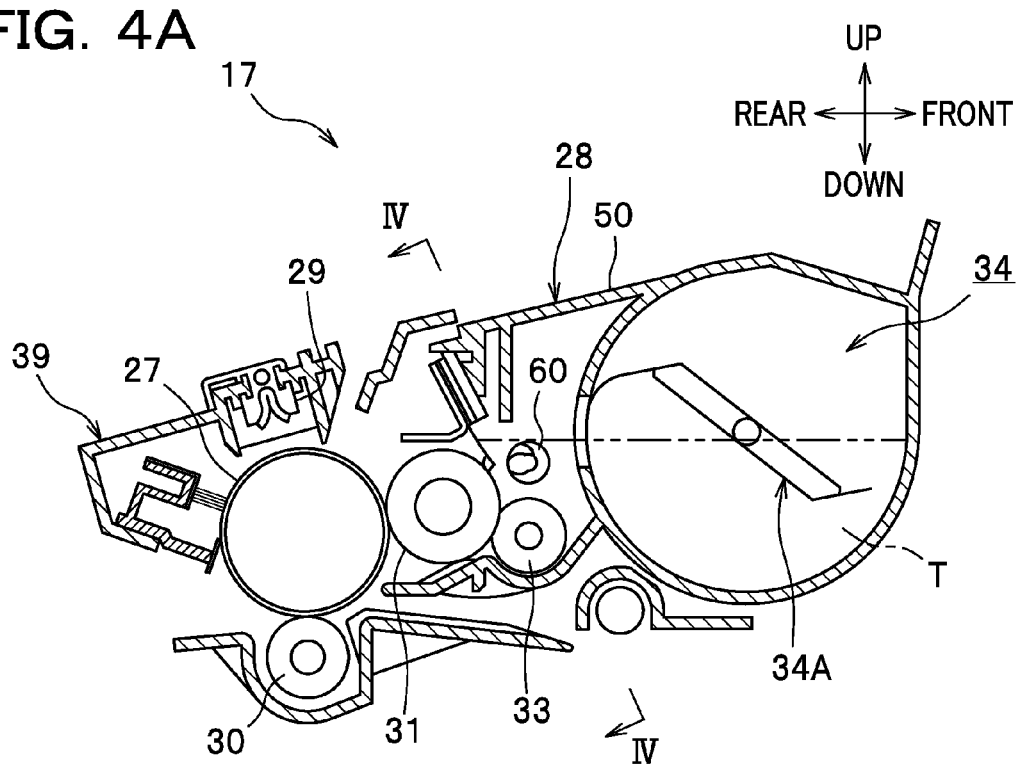

In the above embodiment, the level of the toner T is adjusted to be lower than the contacting portion N. However, the present invention is not limited to this specific configuration. For example, as best seen in FIG. 4A, the level of the toner T may be higher than the contacting portion N. In this modification, an auger 60 as an example of an agitating member is provided in the developing cartridge 28 for the purpose of agitating toner T in the vicinity of the contacting portion N and preventing retention of the toner T.

To be more specific, the auger 60 is rotatably supported by the case body 50 at a position above the supply roller 33, and arranged forward of and adjacent to the doctor blade 100. The auger 60 is driven to rotate when receiving a driving force from a driving motor (not shown) provided in the main body casing 2.

Figure 4B:
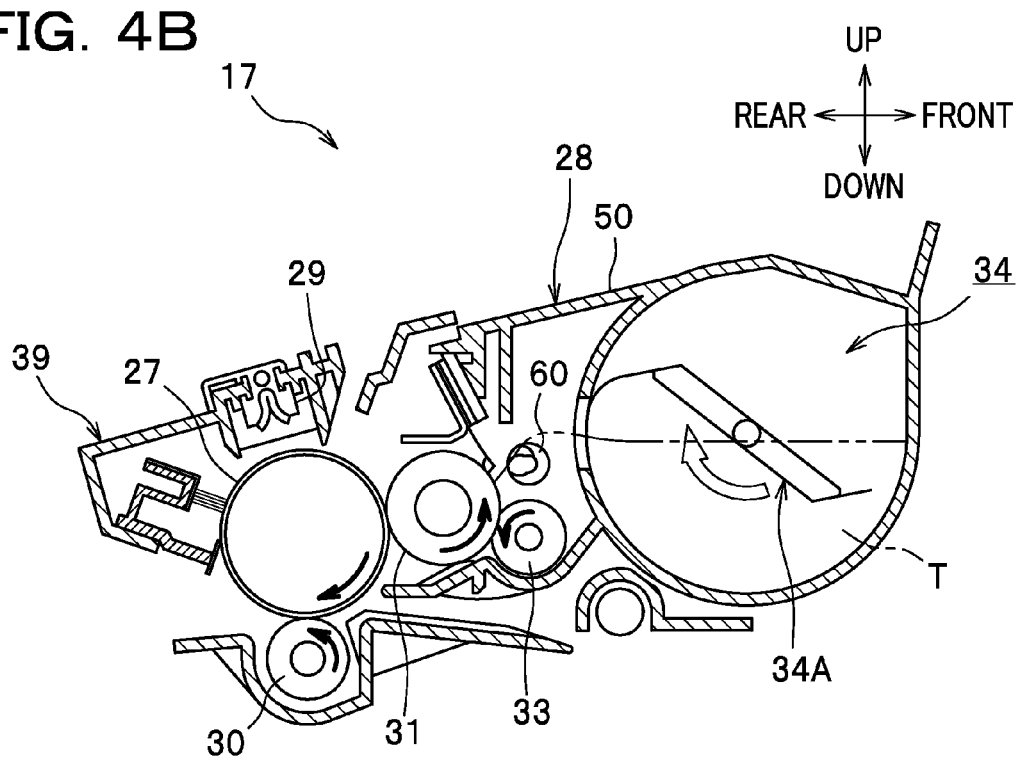
Figure 5:
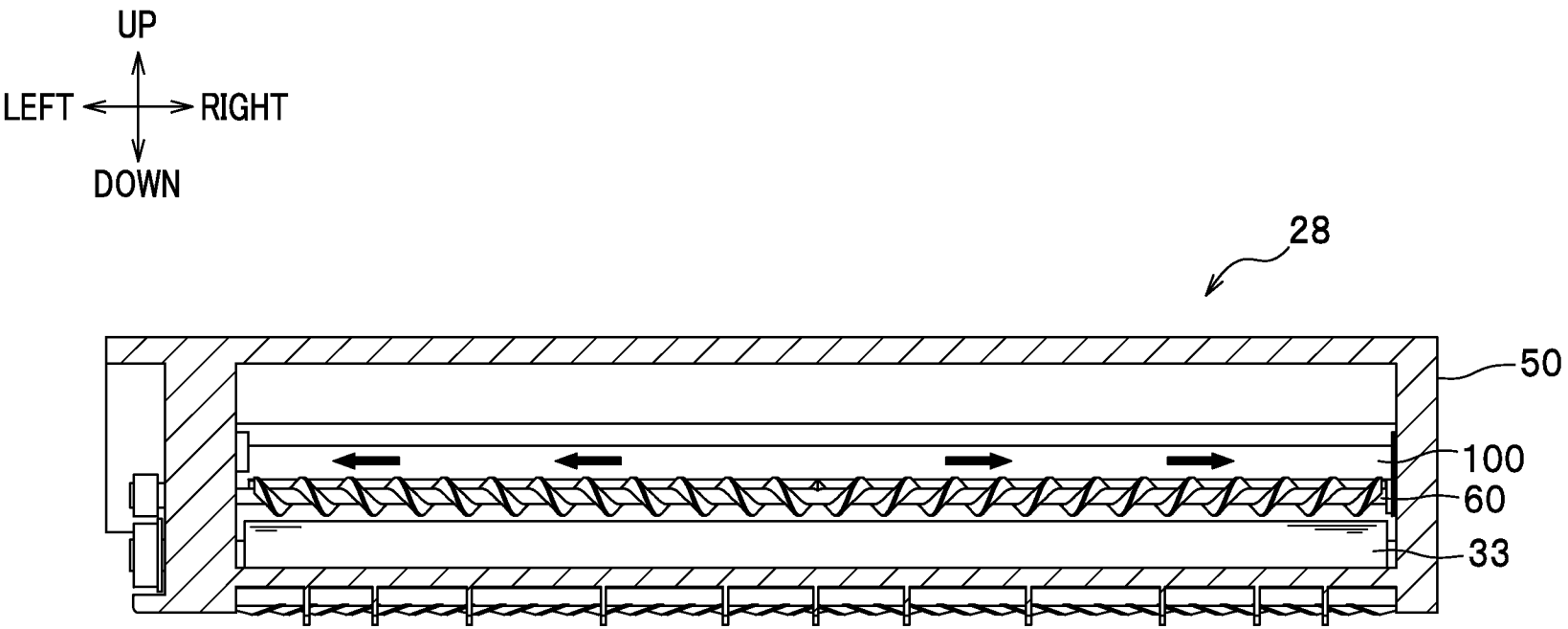
FIG. 5 is a sectional view taken along the line IV-IV of FIG. 4A.

As seen in FIG. 5, when the auger 60 rotates, toner T is moved outward around the auger 60 in the rightward direction or in the leftward direction. Accordingly, as best seen in FIG. 4B, the toner T is agitated without being accumulated in the vicinity of the contacting portion N. Since the excess toner T scraped off by the contacting portion N and foreign objects will not be accumulated in the vicinity of the contacting portion N, it is possible to prevent foreign objects from being mixed with the toner layer carried on the developing roller 31.

In the above embodiment, the pressing portion 120 is made of rubber. However, the present invention is not limited to this specific configuration. For example, the pressing portion may be made of plastic or other resin materials.

In the above embodiment, the doctor blade 100 consists of the supporting plate 110 and the pressing portion 120. However, the present invention is not limited to this specific configuration. For example, the doctor blade may be configured such that the supporting plate and the pressing portion are integrally formed without including a rubber-made pressing portion and made of stainless material, and its metallic surface may directly contact the developing roller 31.

In the above embodiment, the end face 121 is a flat surface. However, the end face 121 may be a curved surface. In this modification, the angle $\alpha$ is an angle between the end face 121 at a position in proximity to the surface of the developing roller 31 and the tangent plane L, as viewed in the cross section orthogonal to the axis of rotation of the developing roller 31.

In the above embodiment, the laser printer 1 is used as an example of an image forming apparatus. However, the present invention is applicable to other image forming apparatuses such as a color laser printer, a multifunction printer and a copying machine.

What is claimed is:

1. A developing cartridge comprising:

a casing configured to store developer;

a developer carrying member rotatably supported by the casing and configured to carry developer on a surface thereof;

a doctor blade provided in contact with the developer carrying member to regulate a thickness of developer carried on the developer carrying member;

a supply roller configured to supply developer to the developer carrying member; and an agitating member arranged above the supply roller and configured to agitate the developer, the developer carrying member being rotatable with a photoconductor on which an electrostatic latent image is formed while contacting the photoconductor, to thereby supply developer onto the photoconductor, wherein the doctor blade includes a supporting plate having a proximal end portion supported by the casing and a distal end portion contacting the developer carrying member, wherein a pressing portion is provided on the distal end portion to define a contacting portion at which the doctor blade contacts the surface of the developer carrying member;

wherein the pressing portion has an end face extending in a direction away from the developer carrying member from the contacting portion and facing an upstream side in a rotational direction of the developer carrying member;

wherein the supporting plate of the doctor blade is supported by the casing such that the proximal end portion thereof is positioned downstream from the contacting portion of the pressing portion in the rotational direction of the developer carrying member; and wherein an angle $\alpha$ between the end face and a plane tangent to the contacting portion, at a position in proximity to the surface of the developer carrying member, is equal to or greater than 90 degrees, as viewed in a cross section orthogonal to an axis of rotation of the developer carrying member, wherein a level of the developer in the developing cartridge is higher than the contacting portion.

2. The developing cartridge according to claim 1, wherein the angle $\alpha$ is an obtuse angle.

3. The developing cartridge according to claim 1, wherein the pressing portion is made of rubber and supported on the distal end portion of the supporting plate.

4. The developing cartridge according to claim 1, wherein the developer is composed of spherical toner particles.

5. The developing cartridge according to claim 1, wherein a level of the developer in the developing cartridge is lower than the contacting portion.

* * * * *